US005483268A

United States Patent [19]

Fujimoto

[11] Patent Number: 5,483,268

[45] Date of Patent: Jan. 9, 1996

[54] METHOD FOR DRIVING INK JET PRINT HEAD

[75] Inventor: Hisayoshi Fujimoto, Kyoto, Japan

[73] Assignee: Rohm Co., Ltd., Kyoto, Japan

[21] Appl. No.: 46,084

[22] Filed: Apr. 12, 1993

[30] Foreign Application Priority Data

Apr. 17, 1992 [JP] Japan ..... 4-097881
Apr. 30, 1992 [JP] Japan ..... 4-110580

[51] Int. Cl.[6] ..... B41J 23/00

[52] U.S. Cl. ..... 347/37; 400/124.04; 400/323; 101/93.04

[58] Field of Search ..... 400/121, 126, 400/322, 323, 328, 320, 568, 582, 124.04; 346/1.1, 134, 139 R; 347/37–39, 104; 101/93.04, 93.05

[56] References Cited

U.S. PATENT DOCUMENTS

| | | | |
|---|---|---|---|
| 4,380,017 | 4/1983 | Ort | 347/39 |
| 4,401,991 | 8/1983 | Martin | 346/75 |
| 4,622,560 | 11/1986 | Withoos et al. | 346/1.1 |
| 4,889,052 | 12/1989 | Matsumoto | 400/568 |
| 4,922,271 | 5/1990 | Nilsson | 400/121 |
| 5,079,571 | 1/1992 | Eriksen | 400/126 |

FOREIGN PATENT DOCUMENTS 0023433 2/1981 European Pat. Off. .
0471488 2/1992 European Pat. Off. .

OTHER PUBLICATIONS

IBM Technical Disclosure Bulletin, vol. 33, No. 10B, Mar. 1991, pp. 81–85.

*Primary Examiner*—David A. Wiecking
*Attorney, Agent, or Firm*—Wolf, Greenfield & Sacks

[57] ABSTRACT

A method for driving an ink jet print head is here disclosed which is characterized by comprising the steps of carrying out printing, while a print head (1) is moved one dot at a time by 4 dots of each nozzle (2) in the print head (1) in one print scanning direction in one print line on a print paper; further repeating the printing operation 4 times in the one direction in this print line; carrying out printing, while the print head (1) is moved one dot at a time by 4 dots in another print scanning direction; further repeating the printing operation 4 times in the other direction in this print line; and then terminating one reciprocating motion of the print head (1) in the print scanning direction at a point when the print head (1) has returned to a print motion starting point.

The method of the present invention permits preventing the disorder of print and the introduction of bubbles into the ink, decreasing cost, improving productivity, obtaining a high-quality print even by the use of a relatively low-density head, and smoothing a shuttle motion.

18 Claims, 4 Drawing Sheets

METHOD FOR DRIVING INK JET PRINT HEAD

BACKGROUND OF THE INVENTION (i) Field of the Invention

The present invention relates to a method for driving an ink jet print head installed in electronic equipment such as printers, word processors, facsimile machines and plotters.

(ii) Description of the Related Art

FIG. 6 shows an embodiment in which a driving method usually used in a thermal print head having a relatively low print density is directly applied to an ink jet print head. In the embodiment of FIG. 6, a print dot unit is 2 dots/mm and the print density is 8 dots/mm, and print dots of 12 nozzles 11 (A to L) provided in an ink jet print head 10 are illustratively represented by alphabetic characters corresponding to alphabetic characters attached to the respective nozzles 11. In this embodiment, each of these nozzles 11 prints 4 dots. In the first print line on a print paper, the head 10 is moved one dot at a time by 4 dots in one print scanning direction (in a right direction in the drawing) from a print motion starting point (the left edge of the drawing). At this time, printing is carried out by the predetermined nozzles 11 in accordance with print information. When the printing of this first print line has terminated, the head 10 has been shifted (to the fifth dot) to the right side by 4 dots.

Next, the print paper is advanced one print line, and printing is then done, while the head 10 is moved one dot at a time by 4 dots in another print scanning direction (in a eft direction in the drawing). Here, the printing of the second print line is completed, and the head 10 is returned to the print starting point. Afterward, the reciprocating motion is similarly carried out in the print scanning directions every two print lines.

If a print time for one print line in the printing operation in FIG. 6 is 5 ms, a time required for one reciprocating motion of the head 10 (hereinafter referred to as "a shuttle driving cycle at times", (see a symbol T' in FIG. 6) is 10 ms, and a shuttle driving frequency is 100 Hz.

In the case that a driving method of a thermal print head having a relatively low density is directly applied to an ink jet print head, an ink jet print head must be operated at the above-mentioned shuttle driving cycle and driving frequency. However, for the ink jet print head, the driving cycle is very short and the driving frequency is fairly high, and therefore vibration is generated during the printing operation, so that printed letters are disordered and bubbles are introduced into an ink which gives rise to undesirable lack of emergence of the ink.

Furthermore, since a time of from the completion of the printing in one print line to the start of the printing in the next print line, i.e., a time required for a paper feed is longer than a pulse cycle of ink discharge (which corresponds to a cycle of ink adhesion to the paper, i.e., the time it takes for the ink to hit the paper), a movement speed of the shuttle (the head 10) is not constant. In consequence, the operation of the shuttle is stiff, which has a bad influence on a print quality.

SUMMARY OF THE INVENTION

An object of the present invention is to provide a method for driving an ink jet print head, and according to this driving method, the disorder of print and the introduction of bubbles into an ink can be prevented, a more inexpensive head than a high-density head can be used, productivity is higher than the high-density head, a high-density print can be obtained even by means of a head having a relatively low density, and a shuttle operation is also smooth.

In order to achieve the above-mentioned object, a method for driving an ink jet print head of the present invention is characterized by comprising the steps of carrying out printing, while a print head is moved one dot at a time by the print dot number of each nozzle in the print head in one print scanning direction in one print line on a print paper; further repeating the printing operation once or more in the one direction in this print line; carrying out printing, while the print head is moved one dot at a time by the print dot number in another print scanning direction in one print line; further doing the printing operation the number of times of the above repeat operation in the other direction in this print line; and then terminating one reciprocating motion of the print head in the print scanning direction at a point when the print head has returned to a print motion starting point.

According to this driving method, a shuttle driving cycle in which one reciprocation of the print head is done is long, and a driving frequency is low. In other words, in a driving method which is usually used for a thermal print head having a relatively low density, the number of the print lines in the one reciprocating motion of the head is two, but in the driving method of the present invention, the number of the print lines is four or more (in a minimum case, two lines in one print scanning direction and two lines in the other print direction). Thus, the reciprocating motion of the head is correspondingly slowly carried out. In consequence, problems such as the disorder of the print and the introduction of bubbles into the ink can be solved.

Additionally, according to the above-mentioned driving method, a paper feed operation is begun after the ink has adhered to the print paper, and the paper feed operation is completed in a shorter time than an ink discharge cycle, so that the paper feed operation can be terminated within the ink discharge cycle. Therefore, it is not necessary to put a special interval between the completion of the printing in the first print line and the start of the printing in the next print line, whereby the printing operation can be smoothed, with the results that the shuttle operation can also be smoothed.

DETAILED DESCRIPTION OF PREFERRED EMBODIMENTS

Now, a method for driving an ink jet print head of the present invention will be described in reference to examples.

Figure 1:
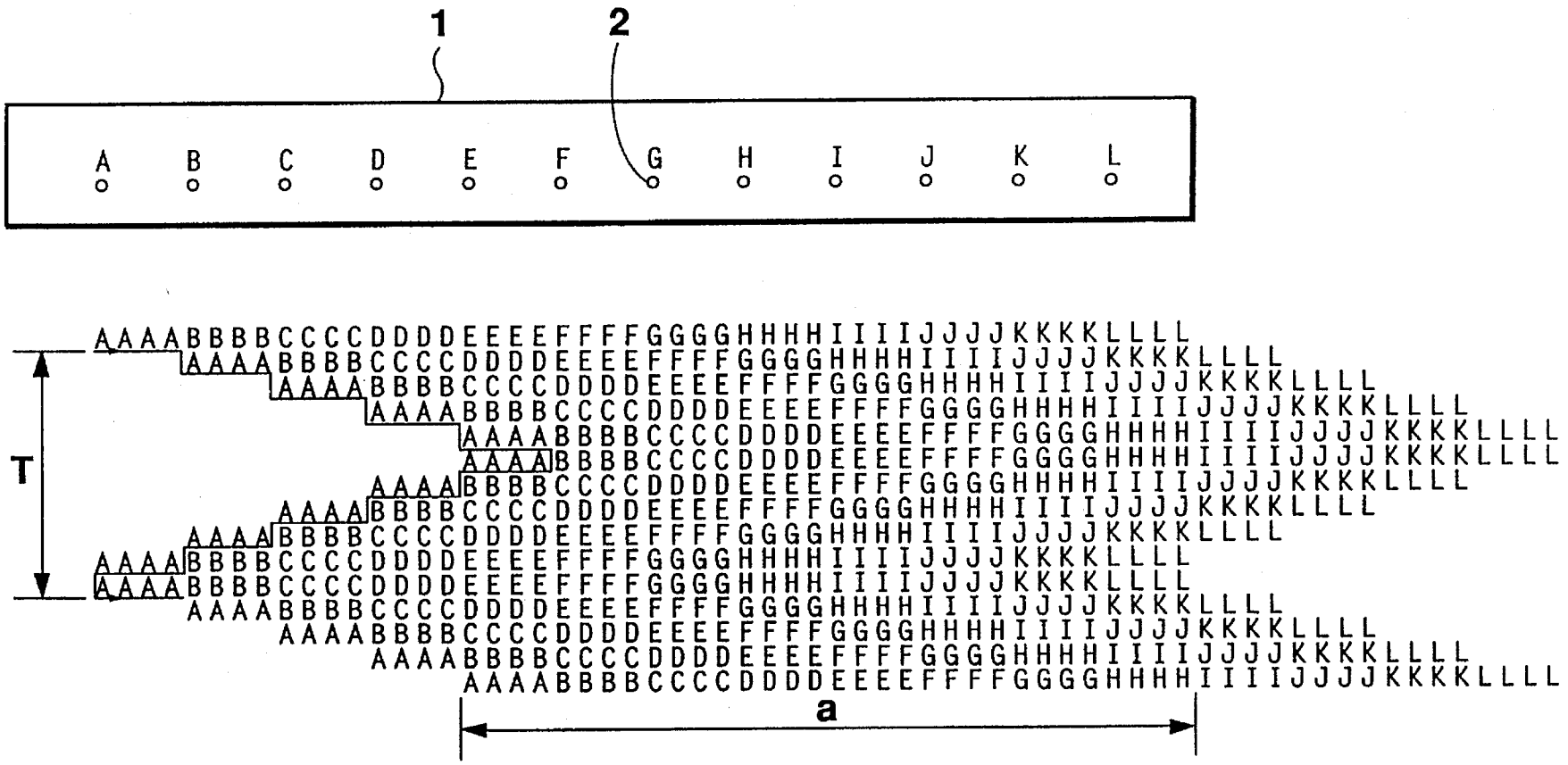
FIG. 1 shows a schematic view illustrating a print head and its printing operation in order to explain a driving method of the present invention.
Figure 6:
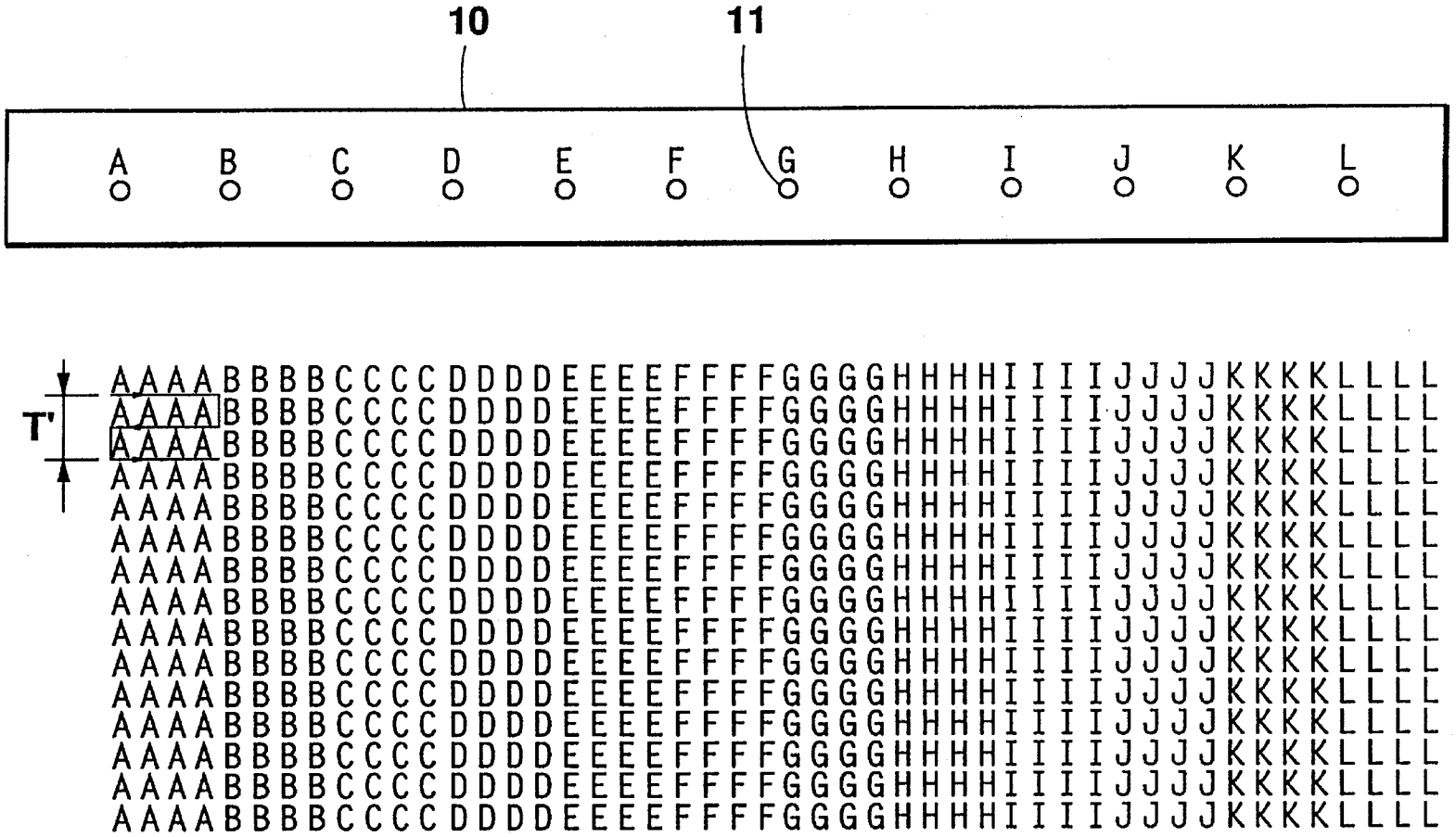
Fig. 6 PRIOR ART
FIG. 6 shows a schematic view illustrating the print head and its printing operation in order to explain a case where a driving method suitable for a thermal print head is applied to the ink jet print head.

In FIG. 1, dots of each nozzle 2 in a print head 1 having the 12 nozzles 2 (A to L) are illustratively represented by alphabetic characters corresponding to alphabetic characters attached to the respective nozzles 2, as shown in FIG. 6. As is apparent from this drawing, in this embodiment, each nozzle 2 has four dots, and print lines in one reciprocating motion of the head 1 are 10 lines. In this case, if a print time in one print line is 5 ms, a time required for one reciprocating motion of the head 1, i.e., a shuttle driving cycle T is 50 ms and a shuttle driving frequency is 20 Hz. Compared with a driving method of a thermal print head, the driving cycle is considerably longer and the driving frequency is much lower.

Next, reference will be made to the printing operation of this print head 1. If a significant print width a on a print paper at a time when the head 1 is present at a print motion starting point (the left edge in the drawing) is a length corresponding to the 8 nozzles from the nozzle E to the nozzle L, printing is first carried out, while the print head 1 is moved one dot at a time by 4 dots in one print scanning direction (in the right direction in the drawing) in the first print line on the print paper. This time, the nozzles which take part in the printing operation are the nozzles E to L, and these nozzles E to L perform the printing operation in accordance with print information. That is, the first letter print in the first print line is effected by the nozzle E, and the last letter print is done by the nozzle L. At a point when the printing in the first print line has been completed, the head 1 is located at a position (the fifth dot) shifted to the right side by 4 dots from the print motion starting point.

After the paper has been fed one print line, printing is similarly carried out in the next print line in accordance with the print information, while the head 1 is moved one dot at a time by 4 dots in a right direction. The nozzles which take part in this printing operation are the nozzles D to K, and the other nozzles are not concerned with the printing operation. When the printing in the second print line has terminated, the head 1 is located at a position further shifted to the right side by 4 dots, i.e., at the 9th dot from the print motion starting point.

Afterward, the printing operation is similarly repeated until the 5th print line. As a result, the printing in the 5th print line is carried out by the nozzles A to H. After the printing in the 5th print line has terminated and the paper is fed one print line, the printing operation in the next 6th print line is done in a direction opposite to the preceding print direction. That is, this time, the printing is done, while the print head 1 is moved one dot at a time by 4 dots in another print scanning direction (in the left direction in the drawing) in one print line. When this printing operation has been performed until the 10th print line, the head 1 returns to the print motion starting point at the left edge. At this time, one reciprocating motion of the head 1 has been achieved over the 1st to the 10th print lines, and a time required for this reciprocating motion is a shuttle driving cycle T.

The printing in the 11th print line et seq. can be effected by repeating the above-mentioned printing operation. However, in this embodiment in which such a driving method is carried out, the head 1 is required to be elongated as much as 4 dots ×(5−1): 16 dots. In short, when a print density of 8 dots/mm is used, it is necessary to elongate the head 1 as much as about 2 mm. However, the elongation of the head 1 is such as to be sufficiently allowable in view of a great effect obtained by the driving method of the present invention. Moreover, matching between the print information and the print position in the printing operation can relatively easily be carried out by hardware or software, as described hereinafter.

As another embodiment, if the print time required for one print line is similarly 5 ms in the case that one reciprocating motion of the head 1 is achieved by 100 print lines in the illustrative view of FIG. 1, a shuttle driving cycle is 500 ms and a driving frequency is 2 Hz. Therefore, the driving cycle is remarkably prolonged, and particularly the driving frequency is noticeably below the lower limit (about 20 Hz) of the human audio frequency region, with the result that noise attributed to the printing operation can be lowered remarkably. In this case, however, the head 1 must be elongated as much as 4 dots ×(50−1)=196 dots, i.e., at a print density of 8 dots/mm, 196÷8=24.5 mm, but this is not so influential as described above.

According to the driving method of the present invention just described, vibration in the printing operation can be reduced, whereby problems such as the disorder of the print and the introduction of bubbles into the ink can be solved, and even if, for example, the nozzle 2 is clogged with the ink, an ink absence (no print) is not conspicuous, which is a concomitant effect. This will be apparent from comparison between FIG. 1 showing the driving method of the present invention and FIG. 6 showing the conventional driving method. For example, if the nozzle G of the head 1 shown in FIG. 6 is clogged, the ink absence occurs all over a vertical line of 4 dots which are printed by the nozzle G, so that the portions of the ink absence are conspicuous. On the other hand, if the nozzle G of the head 1 shown in FIG. 1 is clogged, the print position of the nozzle G is shifted in turn in a lateral direction, so that the ink absence does not occur all over the vertical line as in FIG. 6 and the portions of the ink absence are scattered and so they are not so conspicuous.

Figure 2:
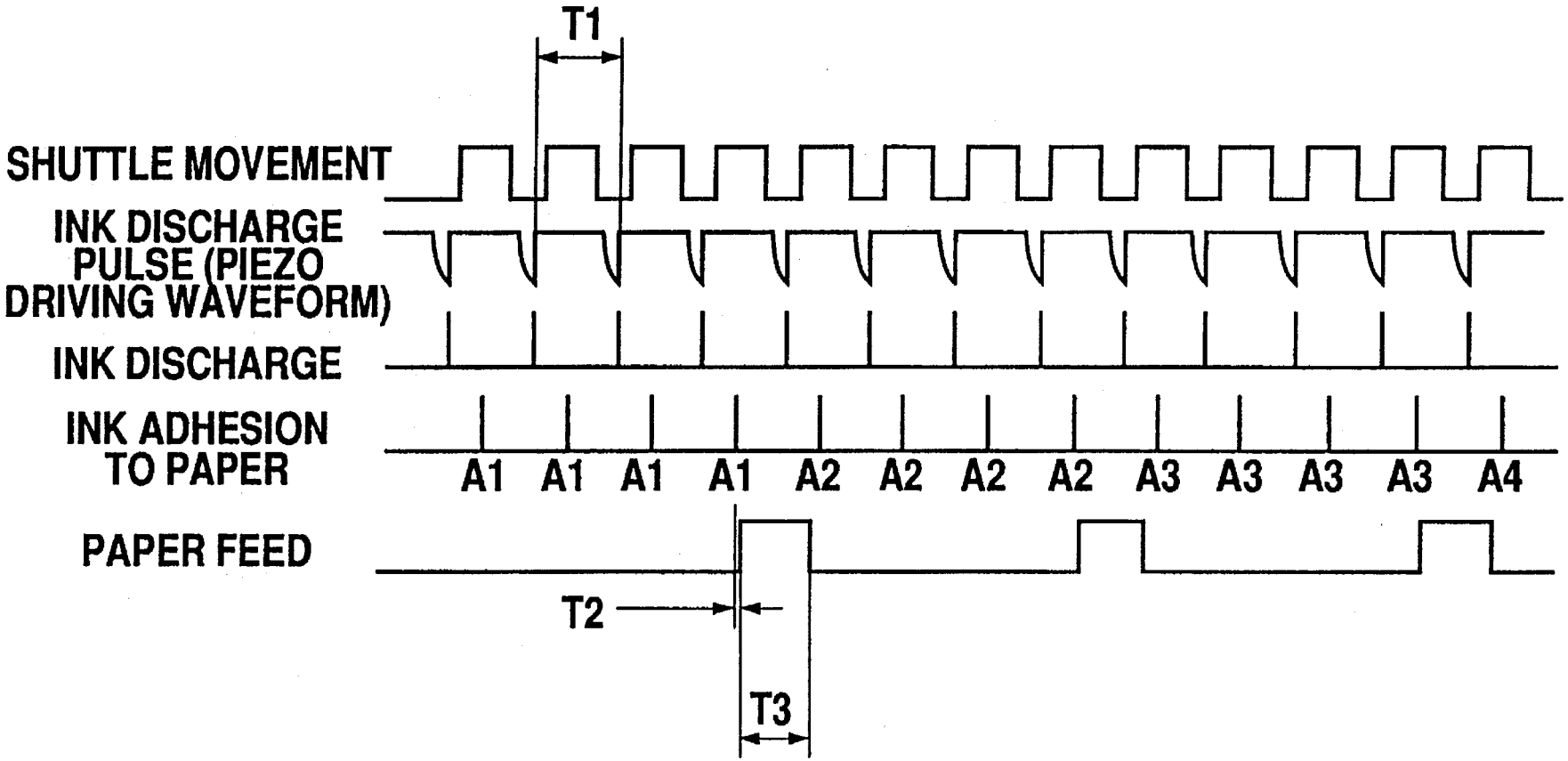
FIG. 2 shows timing charts of a shuttle movement, an ink discharge pulse, an ink discharge, an ink adhesion to a paper and a paper feed.

FIG. 2 shows timing charts of a shuttle (the head 1) movement, an ink discharge pulse (a driving waveform of a piezo element), an ink discharge, an ink adhesion to a paper and a paper feed. In order to smooth the shuttle operation in the driving method of the present invention as described above, it is important that the paper feed operation is begun after the ink has adhered to the print paper and the paper feed operation is completed in a shorter time than an ink discharge cycle. They can be represented by the following formulae (1) and (2) wherein T1 is the ink discharge pulse period, T2 is a time from the ink adhesion on the paper to the beginning of the paper feed operation, and T3 is a time required for the paper feed operation. In FIG. 2, for convenience, only ink adhesion to the paper by the nozzle A is shown, and A1 and A2 represent the ink adhesion to the first line and the next line, respectively, and similarly A3 and A4 represents the ink adhesion to the lines after the line feed.

(1): $T2>0$ (2): $T3<T1$ ($T3 \leqq T1-T2$)

This will be described in more detail. As understood from FIG. 2, the ink discharge cycle and the ink adhesion to the paper are equal to the discharge pulse cycle, and the ink discharge is carried out after completion of discharge pulse application, but the ink adhesion is done after a certain time has elapsed from the ink discharge, because a distance is present between the nozzle 2 and the print paper. In the first line, the printing of 4 dots (A1) is done by the nozzle A, and immediately after the interval of the time T2, the paper feed operation is begun and the paper feed operation is completed in the time of T3. In the chart shown in FIG. 2, the first ink discharge in the next line is carried out during the paper feed operation, but since the paper feed operation is terminated prior to the ink adhesion to the next line, this does not present any trouble, and immediately after the line feed, the printing is done.

In this connection, the paper feed timing is set so that the time of the ink adhesion to the paper may be calculated from the distance between the nozzle and the paper on the basis of an ink discharge velocity, and so that the paper feed operation may be completed by the time of the next ink adhesion. Furthermore, the program of this timing can be previously incorporated into a circuit of the print head, and when the ink discharge velocity or the distance the nozzle and the paper is changed, values can be suitably altered. As understood from the foregoing, when the above-mentioned requirements (1) and (2) are utilized in the driving method, the movement speed of the shuttle (the head 1) becomes constant in the printing operation in one line and the paper feed operation, and the shuttle operation becomes smooth, with the result that a print quality is improved.

Figure 3:
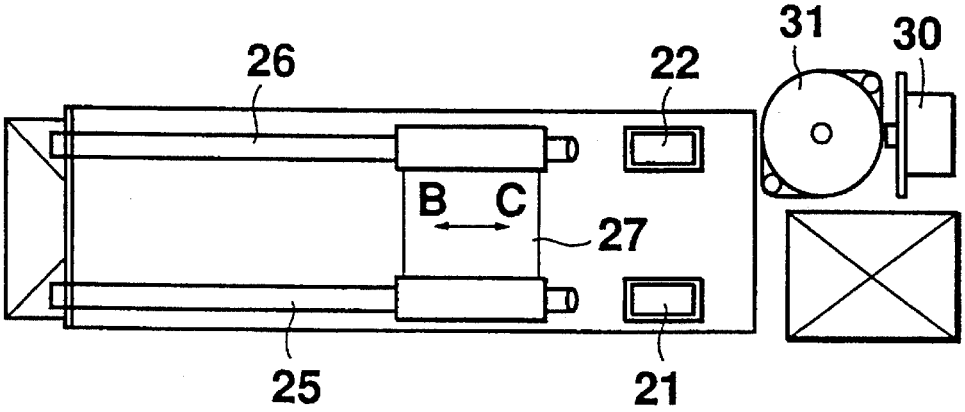
FIG. 3 shows a side view of the main portion of the ink jet printer shown in FIGS. 4 and 5.
Figure 4:
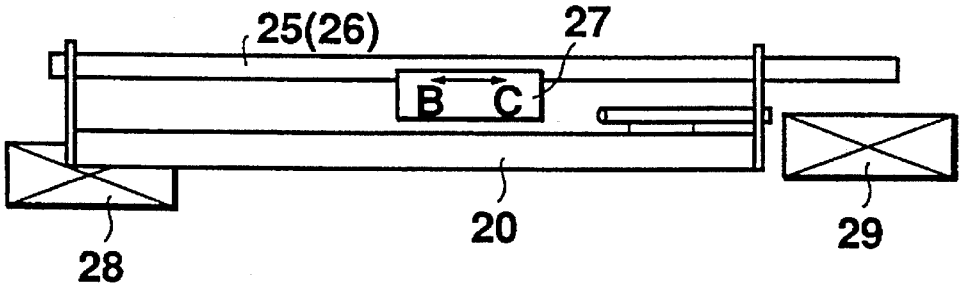
FIG. 4 shows a plan view of the main portion of an ink jet printer into which an ink jet print head of the present invention is incorporated.
Figure 5:
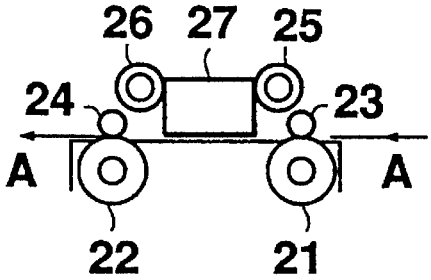
FIG. 5 shows a front view of the main portion of the ink jet printer shown in FIG. 4.

FIGS. 3, 4 and 5 show the whole structure of an ink jet printer having the ink jet print head regarding the present invention therein.

In these drawings, the ink jet printer contains a platen 20, and a recording paper not shown is fed toward the platen 20 as shown by an arrow A in FIG. 5. In order to properly perform the feed of the recording paper, feed rollers 21, 22 are disposed before and after the platen 20, and idler rollers 23, 24 are further disposed so as to confront the feed rollers 21, 22, respectively. A predetermined feed function is carried out by feeding the recording paper between these rollers.

A pair of carriage guides 25, 26 are provided above the platen 20, and a carriage 27 is supported on these carriage guides 25, 26 so as to be capable of reciprocating in the line direction of the recording paper. This carriage 27 is connected to a driving system such as a stepping motor which permits the carriage 27 to move to an optional position in the line direction of the recording paper. Thus, the carriage 27 can reciprocate in a direction indicated by arrows B and C in the drawing.

The ink jet print head 1 shown in FIG. 1 regarding the present invention is incorporated into this carriage 27, and the nozzle 2 is disposed so as to confront the recording paper led on the platen 20. Furthermore, under the platen 20, there are provided an ink cartridge 28 for feeding the ink to the ink Jet print head 1 and a cleaning unit 29 for preventing the ink from solidifying at the time of nonuse of the nozzle 2.

The driving method of the ink jet print head of the present invention is constituted as described above, and therefore the following effects can be exerted.

(1) Since a shuttle driving cycle is prolonged and a shuttle driving frequency is lowered, vibration during a printing operation can be reduced, so that problems such as the disorder of the print and the introduction of bubbles into the ink can be solved. In consequence, the shuttle drive of the ink jet print head is possible, as in a thermal print head.

(2) When the shuttle driving cycle is further shortened and the driving frequency is lowered to such a degree as to be below the lower limit of the human audio frequency region, noise attributed to the printing operation can be reduced remarkably.

(3) Even by the use of the inexpensive ink jet print head having a good productivity and a low density, high-density print can be achieved.

(4) Even when clogging with the ink occurs, ink absence over a whole vertical line can be prevented which takes place in the case that the driving method of the thermal print head is applied as it is, and thus the portions of the ink absence are scarcely conspicuous.

(5) Since the low-density ink jet print head can be used for a high-density print, each ink passage can be widened, whereby the reliability of the ink feed can be improved.

According to the driving method in which a paper feed operation is begun after the ink has adhered to the print paper and the print paper feed operation is completed in a shorter time than an ink discharge cycle the following effects (6) and (7) can be obtained in addition to the above-mentioned effects (1) to (5).

(6) Since the shuttle (head) operation can be smoothed, the disorder of the print and the introduction of bubbles into the ink can be prevented more effectively.

(7) Since the print paper feed operation is carried out after the adhesion of the ink to the print paper, a high-quality print can be obtained without any dot deviation.

What is claimed is:

1. A method for driving an ink jet print head to print on successive lines on a medium, the ink jet print head having a number of nozzles, each of which prints up to a certain print dot number of dots in a single line on the medium, the ink jet print head being movable in a first direction and in a second direction which is opposite the first direction, wherein a feeding mechanism moves the medium relative to the print head in a third direction perpendicular to the first and second directions so that the ink jet print head faces a selected line, the method comprising the steps of:

(a) moving the ink jet print head one dot at a time for the print dot number in the first direction along a first line on the medium;

(b) selectively printing dots on the medium during step (a);

(c) before moving the ink jet print head in the second direction, moving the medium relative to the print head in the third direction so that the print head faces a next line;

(d) before moving the print head in the second direction, moving the ink jet print head one dot at a time for the print dot number in the first direction along the next line; and (e) selectively printing dots on the medium during step (d) in the first direction along the next line.

2. The method of claim 1, wherein step (c) is performed a time after step (b), the time being longer than a time for ink to adhere to the medium.

3. The method of claim 1, wherein steps (c)–(e) are performed a total of n−1 times in the first direction, wherein n is an integer greater than or equal to 2, the method further comprising the steps of:

(f) moving the medium relative to the print head in the third direction so that the print head faces a next line;

(g) moving the ink jet print head one dot at a time for the print dot number in the second direction along a line on the medium;

(h) selectively printing dots on the medium during step (f); and (i) repeating steps (f)–(h)in the second direction n times.

4. The method of claim 3, wherein the print dot number is 4 so that each nozzle prints up to 4 dots in each line.

5. The method of claim 3, wherein n=5.

6. The method of claim 3, wherein step ĉ is performed a time after a preceding step, the time being longer than a time for ink to adhere to the medium.

7. The method of claim 1, further comprising the steps of repeating steps (c)–(e) so that steps (d) and (e) are performed at least two times so that dots are printed on at least three lines.

8. The method of claim 7, wherein steps (c)–(e) are performed a total of n−1 times in the first direction, wherein n is an integer greater than or equal to 1, the method further comprising the following steps after step (e):

(f) moving the medium relative to the print head in the third direction so that the print head faces a next line;

(g) moving the ink jet print head one dot at a time for the print dot number in the second direction along next a line;

(h) selectively printing dots on the medium during step (f); and (i) repeating steps (f)–(h)in the second direction n times.

9. The method of claim 7, wherein the print dot number is d, wherein the printing is done on a total of n lines in the first direction, wherein an overall print area has a width w, and wherein the print head has (n–1)+w/d nozzles.

10. The method of claim 9, wherein the nozzles are arranged in a line from a first to a last, wherein the first nozzle and the last nozzle each face the overall print area 1/n of a printing time.

11. The method of claim 10, wherein the n-th nozzle faces the overall print area all of the printing time.

12. A method for driving a reciprocating ink jet print head to print on a medium to reduce the frequency of reciprocations, wherein the ink jet print head has a number of nozzles, each of which prints up to d dots in a single line, wherein the print head moves in a first direction and a second direction which is opposite the first direction, wherein the medium is fed in a third direction orthogonal to the first and second directions, the method comprising the steps of:

moving the ink jet print head by n×d dots in the first direction from an initial position, wherein n is an integer;

selectively printing on the medium during the moving step;

feeding the medium in the third direction after each time the print head moves d dots so that the print head moves in the first direction n times and faces n lines before moving in the second direction;

moving the ink jet print head by n×d dots in the second direction to return to the initial position;

selectively printing on the medium during the step of moving the ink jet print head in the second direction; and feeding the medium in the third direction after each time the print head moves by d dots so that the print head moves in the second direction n times and faces n lines before returning to the initial position.

13. The method of claim 12, wherein ink is discharged every t seconds, wherein the step of feeding is done after the ink from a most recent discharge has adhered to the print paper, and wherein the feeding step is completed in a time less than t.

14. The method of claim 12, wherein the moving steps are performed so that a driving cycle is at least about 50 ms, wherein the driving cycle is a time for the print head to move in the first direction then move in the second direction to return to the initial position.

15. The method of claim 12, wherein the nozzles are arranged in a line from a first to a last, and wherein the first nozzle and the last nozzle each face a print area 1/n of a printing time.

16. The method of claim 15, wherein the n-th nozzle faces the print area all of the printing time.

17. The method of claim 12, wherein the moving steps are performed so that a driving cycle is at least about 50 ms, wherein the driving cycle is a time for the print head to move in the first direction then move in the second direction to return to the initial position.

18. A method for driving a reciprocating ink jet print head having a plurality of nozzles which each selectively print up to d dots in a single line over a print area having a width of w dots, the print head being moveable for printing in a first direction and in a second direction which is opposite the first direction, the method comprising the steps of:

moving n×d dots in a first direction before printing in the second direction; and printing up to n×d dots in a first direction using an elongated print head wherein the number of nozzles equals (n–1)+w/d.

* * * * *